US007656091B2

(12) United States Patent
Kim

(10) Patent No.: US 7,656,091 B2
(45) Date of Patent: Feb. 2, 2010

(54) PLASMA DISPLAY PANEL WITH IMPROVED BARRIER RIB STRUCTURE

(75) Inventor: Dong Hyun Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 323 days.

(21) Appl. No.: 11/838,176

(22) Filed: Aug. 13, 2007

(65) Prior Publication Data

US 2008/0079366 A1 Apr. 3, 2008

(30) Foreign Application Priority Data

Sep. 28, 2006 (KR) ..... 10-2006-0095114

(51) Int. Cl.
*H01J 17/49* (2006.01)

(52) U.S. Cl. ..... 313/586; 313/582

(58) Field of Classification Search ..... 313/582–587, 313/292

See application file for complete search history.

(56) References Cited

U.S. PATENT DOCUMENTS

| | | | | |
|---|---|---|---|---|
| 6,172,454 | B1 * | 1/2001 | Hofmann | 313/495 |
| 6,670,757 | B2 * | 12/2003 | Kato et al. | 313/587 |
| 7,217,376 | B2 | 5/2007 | Ikarashi | |
| 7,548,024 | B2 * | 6/2009 | Setoguchi et al. | 313/582 |
| 2005/0001548 | A1 * | 1/2005 | Sawa et al. | 313/582 |

FOREIGN PATENT DOCUMENTS

| | | |
|---|---|---|
| JP | 11-339668 | 12/1999 |
| KR | 10-2005-0012171 | 1/2005 |
| KR | 10-2006-0027516 | 3/2006 |

OTHER PUBLICATIONS

Korean Patent Abstracts, Publication No. 1020050012171 A, Date of Publication: Jan. 31, 2005, in the name of Youichi Ikarashi.
Patent Abstracts of Japan, Publication No. 11-339668, dated Dec. 10, 1999, in the name of Yuichiro Iguchi et al.
Korean Patent Abstracts, Publication No. 1020060027516, dated Mar. 28, 2006, in the name of Yong Jun Kim et al.

* cited by examiner

*Primary Examiner*—Peter Macchiarolo
(74) *Attorney, Agent, or Firm*—Christie, Parker & Hale, LLP

(57) ABSTRACT

A plasma display panel (PDP) includes a front substrate having sustain discharge electrodes composed of X electrodes and Y electrodes. A rear substrate is arranged parallel with the front substrate, the rear substrate having address electrodes crossing the sustain discharge electrodes. An upper dielectric layer buries the sustain discharge electrodes. A lower dielectric layer buries the address electrodes. A barrier rib is located between the first substrate and the second substrate. The barrier rib has discharge spaces between the front substrate and the rear substrate and has a circumferential region formed at a lower height than a height of its central region. A frit is arranged spaced along a circumference of the barrier rib to attach the rear substrate to the front substrate.

18 Claims, 2 Drawing Sheets

PLASMA DISPLAY PANEL WITH IMPROVED BARRIER RIB STRUCTURE

CROSS-REFERENCE TO RELATED APPLICATIONS

This application claims priority to and the benefit of Korean Patent Application No. 2006-0095114, filed on Sep. 28, 2006, in the Korean Intellectual Property Office, the entire content of which is incorporated herein by reference.

BACKGROUND

1. Field of the Invention

The present invention relates to a plasma display panel with an improved barrier rib structure.

2. Discussion of Related Art

Generally, a plasma display panel (PDP) is a type of light emitting device for displaying a color image using a gas discharging phenomenon in each cell. The PDP has a simple manufacturing process and a swift response time.

The PDPs are mainly divided into DC PDP and AC PDP types, depending on its mode of operation, and also mainly divided into opposed discharge PDP and surface discharge PDP types, depending on how the electrodes are constructed for electric discharge.

SUMMARY OF THE INVENTION

A PDP with an improved barrier rib is provided. The PDP includes a front substrate having sustain discharge electrodes composed of X electrodes and Y electrodes. A rear substrate is arranged parallel with the front substrate. The rear substrate has address electrodes crossing the sustain discharge electrodes. An upper dielectric layer buries the sustain discharge electrodes. A lower dielectric layer buries the address electrodes. A barrier rib is located between the front substrate and the rear substrate, the barrier rib having discharge spaces between the front substrate and the rear substrate and having a barrier rib central region and a barrier rib circumferential region, the barrier rib central region having a central region height and the barrier rib circumferential region having a circumferential region height, the central region height being greater than the circumferential region height. A frit is arranged spaced along a circumference of the barrier rib to attach the rear substrate to the front substrate.

In another exemplary embodiment, the circumferential region height satisfies the equation $0.96H_M<H_E<0.98H_M$, wherein $H_M$ is the central region height, and $H_E$ is the circumferential region height.

In another exemplary embodiment, the barrier rib central region has a central region width and the barrier rib circumferential region has a circumferential region width, the circumferential region width satisfying the equation $W_E<0.02W_M$, wherein $W_E$ is the circumferential region width, and $W_M$ is the central region width.

In another exemplary embodiment, the upper dielectric layer and the lower dielectric layer are installed on the front substrate and the rear substrate, respectively, with a constant thickness.

In another exemplary embodiment, when a thickness of the upper dielectric layer or the lower dielectric layer is changed, the circumferential region height satisfies the equation $0.96H_M-XT_D<H_E<0.98H_M-XT_D$, wherein $H_M$ is the central region height, $H_E$ is the circumferential region height, and $XT_D$ is a total thickness of the upper dielectric layer and the lower dielectric layer of the barrier rib circumferential region minus a total thickness of the upper dielectric layer and the lower dielectric layer of the barrier rib central region.

In another exemplary embodiment, the barrier rib circumferential region and the barrier rib central region are formed with step protrusions, the step protrusions of the barrier rib central region having a greater height than a height of the step protrusions of the barrier rib circumferential region.

In another exemplary embodiment, the barrier rib circumferential region and the barrier rib central region are formed with incline planes, the incline planes of the barrier rib central region having a greater height than a height of the incline planes of the barrier rib circumferential region.

In another exemplary embodiment, a passivation layer for protecting a surface is located on the upper dielectric layer.

In another exemplary embodiment, the discharge space of the barrier rib includes a phosphor layer which emits red, green, and blue light.

DETAILED DESCRIPTION

Figure 1:
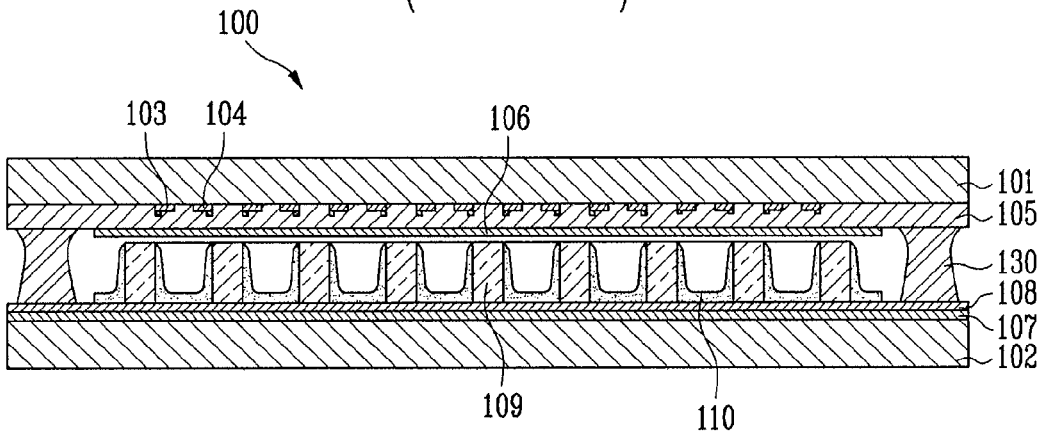
FIG. 1 (PRIOR ART)
FIG. 1 is a cross-sectional view showing an inner structure of a conventional plasma display panel.

FIG. 1 shows a cross-sectional view of an inner structure of a conventional AC PDP. A PDP 100 includes front and rear substrates 101, 102; sustain discharge electrodes 103, 104 having pairs of X and Y electrodes alternately arranged at a bottom of the front substrate 101; a front dielectric layer 105 for covering the X and Y electrodes; a passivation layer 106 formed in a surface of the front dielectric layer 105; an address electrode 107 arranged at a top surface of the rear substrate 102 and installed to correspond to crossed directions of the X and Y electrode; a rear dielectric layer 108 for covering the address electrode 107; a barrier rib 109 installed between the front and rear substrates 101, 102 to form a discharge space; and red, green and blue phosphor layers 110 applied inside the barrier rib 109.

The front and rear substrate 101, 102 face each other on both sides of a predetermined gap, and a space formed therefrom is filled with a mixed gas of Ne+Xe, a mixed gas of He+Ne+Xe, and the like at a constant pressure, the mixed gas generating ultraviolet rays.

A frit 130 is installed in a circumferential region between the front and rear substrates 101, 102 spaced from the barrier rib 109, the frit 130 being manufactured and arranged to be at the same height as the barrier rib 109 to attach the front and rear substrates 101, 102 to each other.

The frit 130 is a low-temperature cofired ceramic mixture having various compositions, which is installed at a higher level than the height of the barrier rib 109 to prevent the frit 130 from colliding with the top end of the barrier rib 109 when pressing the substrates 101, 102, and softened when the heat is applied to the frit 130 while hardened when its temperature decreases due to removal of the heat.

Also, the frit 130 plays a role in preventing the efflux of the mixed gas charged into the barrier rib 109 in addition to attaching the front substrate 101 and the rear substrate 102 to each other.

In the PDP as configured above, a discharge cell for emitting the light is selected if an electrical signal is applied to the address electrode 107 and the Y electrode 104, and visible rays are emitted from the phosphor 10 applied inside the selected light emitting cell if an electrical signal is alternately applied to the X and Y electrodes 103, 104, thereby realizing an image.

Figure 2:
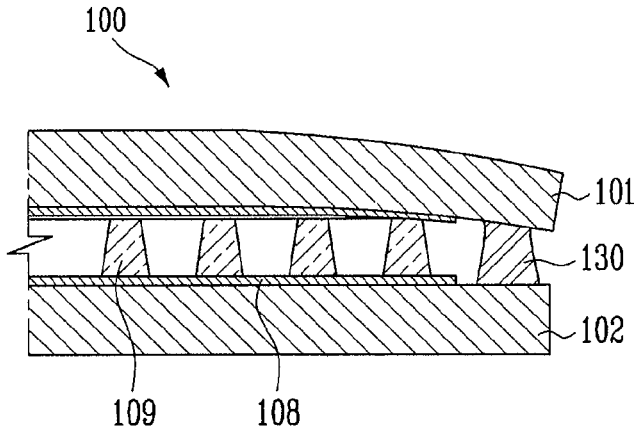
FIG. 2 (PRIOR ART)
FIG. 2 is an illustrative view showing that a panel and a barrier rib have collided with each other in a conventional plasma display panel manufacturing process.

However, when the frit 130 is subject to a hot pressing process to attach the substrates 101, 102 to each other, an inclination, referred to as a phenomenon in which circumferential regions of the front and rear substrates 101, 102 come closer to each other, occurs in the manufacturing process of the PDP 100 because the frit 130 is transformed while being softened and simultaneously its height is lowered to a lower level than that of the barrier rib 109, as shown in FIG. 2.

This inclination phenomenon not only affects the output of pictures in a panel but also causes noise because the substrate 101 and the barrier rib 109 collide with each other while the substrates 101, 102 vibrate due to the frequency caused by external electrical signals supplied to the display panel 100.

Such a severe problem appears particularly in a large number of panels, such as high-definition panels having a large number of pixels, which results in deteriorated product characteristics and low competitiveness of the products.

One embodiment of the present invention is achieved by providing a PDP including a front substrate having sustain discharge electrodes composed of X,Y electrodes; a rear substrate arranged parallel with the front substrate and having address electrodes crossing the sustain discharge electrodes of the front substrate; a dielectric layer for covering the sustain discharge electrodes and the address electrodes; a barrier rib having discharge spaces between the front substrate and the rear substrate and having a circumferential region formed at a lower height than that of its central region; and a frit spaced along a circumference of the barrier rib to attach the rear substrate to the front substrate.

Hereinafter, embodiments of the present invention will be described in detail with reference to the accompanying drawings.

Figure 3:
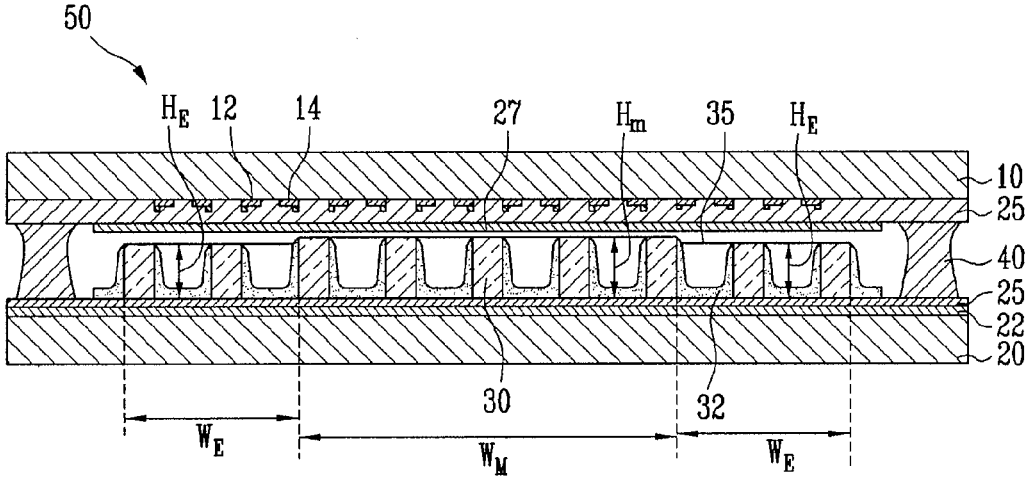
FIG. 3 is a cross-sectional view showing a plasma display panel according to an exemplary embodiment of the present invention.
Figure 4:
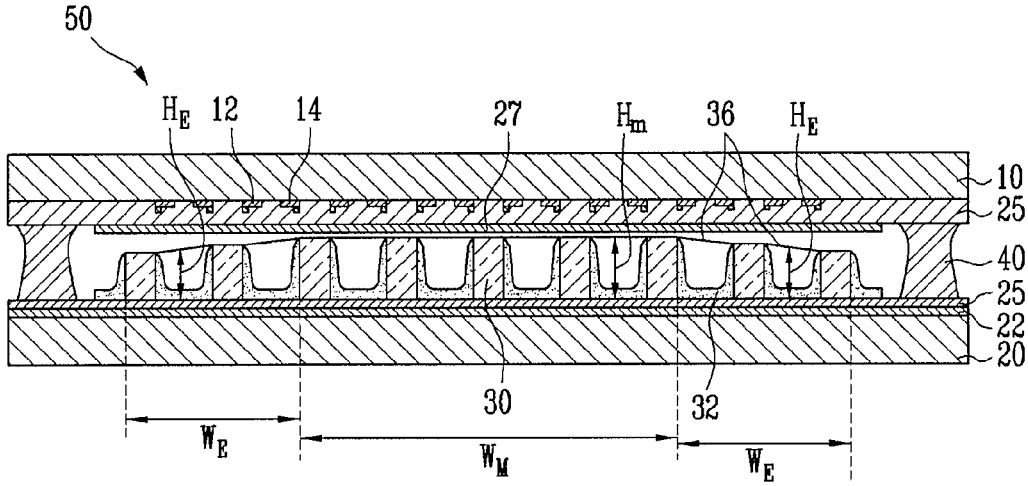
FIG. 4 is a cross-sectional view showing a plasma display panel according to another exemplary embodiment of the present invention.

FIG. 3 is a cross-sectional view showing a PDP according to an exemplary embodiment of the present invention. FIG. 4 is a cross-sectional view showing a PDP according to another exemplary embodiment of the present invention. The PDP of the present invention may be effectively used for full high definition (FHD: Full HD, panel pixel 1920*1080) because the inclination phenomenon is more severe in high-definition panels having a large number of pixels.

As shown in FIGS. 3 and 4, the PDP 50 of the present invention includes a front substrate 10; a rear substrate 20 arranged parallel with the front substrate; a dielectric layer 25; a barrier rib 30 installed between the front and rear substrates 10, 20; and a frit 40 for attaching the front and rear substrates 10, to each other.

The front substrate 10 and the rear substrate 20 are transparent substrates whose sides are arranged spaced at a predetermined distance so that they can be opposite to each other.

Sustain discharge electrodes 12, 14 composed of the X,Y electrodes are installed in the front substrate 10 among the arranged substrates, and address electrodes 22 crossing the sustain discharge electrodes 12, 14 of the front substrate are installed in the rear substrate 20.

Also, the front substrate 10 and the rear substrate 20 includes a dielectric layer 25 for covering the sustain discharge electrodes 12, 14 and the address electrodes 22. The dielectric layer 25 located on the front substrate 10 includes a passivation layer 27 for protecting a surface.

A barrier rib 30 is provided between the front substrate 10 and the rear substrate 20, the barrier rib 30 having discharge spaces which are allowed to emit the light by means of the sustain discharge electrodes 12, 14 and the address electrodes 22. The barrier rib 30 may be fixed to the rear substrate 20, and then the front substrate 10 may be closely attached to the barrier rib 30 and arranged between the front and rear substrates 10, 20.

The barrier rib 30 of an exemplary embodiment of the present invention having a rough lattice pattern will be described, but it is apparent that a shape of the barrier rib may be formed with patterns other than the lattice pattern.

Also, the discharge spaces of the barrier rib 30 has a phosphor layer 32 which emits blue, green and red (RGB) colors. These discharge spaces are filled with a mixed gas of Ne+Xe, a mixed gas of He+Ne+Xe, and the like at a constant pressure, the mixed gas generating ultraviolet rays in addition to the phosphor layer 32.

The barrier rib 30 is formed with step protrusions 35 or incline planes 36 in which the barrier rib in a central region has a greater height than the barrier rib in a circumferential region. That is, the barrier rib 30 is formed with step protrusions 35 or incline planes 36 in which the central region has a greater height than the circumferential region when the barrier rib 30 is viewed while its side end is fixed to the rear substrate 20.

Step protrusions 35 form the barrier rib 30 in a step-like manner as the barrier rib 30 transitions between the circumferential region (encompassed by width $W_E$) and the central region encompassed by width $W_M$). Incline planes form the barrier rib 30 with an increasing height as the central region is approached from the far edge of the circumferential region. That is, the barrier rib 30 formed with step protrusions 35 has a first height $H_E$ in the circumferential region and a second height $H_M$ in the central region, the first height $H_E$ being stepped up to the second height $H_M$ at the central region/circumferential region junction. And, the barrier rib 30 formed with incline planes has an increasing barrier rib height in the circumferential region as the central region is approached, the increasing barrier rib height increasing according to the slope of the incline plane 36 or slopes of the incline planes 36.

Thus the barrier rib 30 may be formed with incline planes 36 rather than step protrusions. Forming the barrier rib 30 with incline planes is equivalent to forming the barrier rib 30 with step protrusions if the slope of the incline planes in both the central and circumferential regions is zero. When step protrusions and incline planes are not equivalent, the incline planes in the circumferential region have a slope greater than zero. In general, because the slope of the incline planes in the circumferential region is at zero or at an incline, and the slope of the incline planes in the central region is zero, the height of the incline planes of the central region will be greater than a height of the incline planes of the circumferential region.

These step protrusions 35 or incline planes 36 are formed to prevent a collision which may appear between the circumference of the barrier rib 30 and the front substrate 10 in the attachment process of the substrates 10, 20.

For this purpose, a height of the step protrusion 35 satisfies the following equation:

$$0.96H_M<H_E<0.98H_M,$$

wherein, $H_M$ is a height (μm) of the central region of the barrier rib in the rear substrate, and $H_E$ is a height (μm) of the circumferential region of the barrier rib in the rear substrate.

As described in the range of the equation, the height of the circumferential region of the barrier rib satisfies a range between a value obtained by multiplying 0.96 by a height of the central region of the barrier rib, and a value obtained by multiplying 0.98 by a height of the central region of the barrier rib.

With the current manufacturing process, $H_M$ has been determined to be approximately 120 μm. Assuming that $H_M$ is 120 μm results in $H_E$ varying according to the following equation:

$$115.5\ \mu m < H_E < 117.5\ \mu m. \quad (1)$$

Also, a width of the circumferential region of the barrier rib satisfies the following equation:

$$W_E < 0.02\ W_M, \quad (2)$$

wherein, $W_E$ is a width (μm) of the circumferential region of the barrier rib having a height $H_E$, and $W_M$ is a width (μm) of the central region of the barrier rib.

The above-mentioned requirements are applied if the dielectric layer has the same thickness in the front substrate 10 among the front and rear substrates. If a changed value in the thickness of the dielectric layer is applied to the equation (1) when the thickness of the dielectric layer is changed in a width region of the circumferential region of the barrier rib applied to the equation (2), then a height difference between a circumferential region of the substrate and a circumferential region of the barrier rib satisfies the following equation:

$$0.96H_M - XT_D < H_E < 0.98H_M - XT_D,$$

wherein, $XT_D$ is in μm and is the total thickness of the upper/lower dielectrics of the circumferential region of the barrier rib minus the total thickness of the upper/lower dielectrics of the central region of the barrier rib.

The barrier rib 30 is installed in the rear substrate 20, and then a frit 40 is fixed and arranged between the front substrate 10 and the rear substrate 20 to attach these substrates to each other.

A low-temperature cofired ceramic mixture having various compositions may be mainly used as the frit 40, the various compositions being selected from the group consisting of PbO, SiO2, Ba2O3, and the like. Both ends of the frit 40 are closely attached to the facing inner sides of the front and rear substrates 10, 20.

The frit 40 serves to attach the front and rear substrates 10, 20 to each other because the frit 40 is softened when it is subject to the heat and pressure to assemble substrates.

If the front and rear substrates 10, 20 are arranged parallel with each other, each of the substrates is heated and pressed.

In this procedure, the frit 40 serves to attach the substrates 10, 20 to each other, but an inclination phenomenon, in which circumferential regions of the front and rear substrates 10, 20 come closer to their central regions, appears because the frit 40 is in a softened state in the heating and pressing processes of the substrates.

The collision with the barrier rib 30 may be prevented in the attachment process of the substrates because the circumferential region of the barrier rib 30 is formed with step protrusions 35 or incline planes 36 to remove interference of each of the substrates.

That is, the height and width of the circumference of the barrier rib 30 according to an exemplary embodiment of the present invention are designed in order to avoid having the front and rear substrates 10, 20 come closer to each other due to the softening of the frit 40. Designing the barrier rib 30 as described in the equations (1) and (2) helps prevent the collision which may appear between the substrate 10 and the barrier rib 30.

Accordingly, noise may be significantly reduced in panels having a large number of pixels are manufactured with the step protrusions 35 or the incline planes 36 formed in the circumferential region of the barrier rib 30.

As described above, the PDP according to the present invention may be useful to improve product characteristics by modifying a barrier rib structure so that its inner components are prevented from colliding with each other in its manufacturing process.

That is, the PDP according to the present invention may be useful to prevent noise from being generated by a collision between the panel and the barrier rib by arranging the barrier rib installed between display panels so that the circumferential region of the barrier rib can have a height difference to its central region, thereby effectively preventing the collision between the panel and the barrier rib in attaching the panels to each other.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel comprising:

a front substrate having sustain discharge electrodes;

a rear substrate arranged parallel with the front substrate, the rear substrate having address electrodes crossing the sustain discharge electrodes;

an upper dielectric layer covering the sustain discharge electrodes;

a lower dielectric layer covering the address electrodes;

a barrier rib located between the front substrate and the rear substrate, the barrier rib forming discharge spaces between the front substrate and the rear substrate and having a barrier rib central region and a barrier rib circumferential region, the barrier rib central region having a central region height and the barrier rib circumferential region having a circumferential region height, the central region height being greater than the circumferential region height; and a frit spaced along a circumference of the barrier rib to attach the rear substrate to the front substrate, wherein the circumferential region height satisfies the equation: $0.96H_M < H_E < 0.98H_M$, wherein $H_M$ is the central region height, and $H_E$ is the circumferential region height.

2. The plasma display panel according to claim 1, wherein the barrier rib central region has a central region width and the barrier rib circumferential region has a circumferential region width, the circumferential region width satisfying the equation:

$$W_E < 0.02W_M,$$

wherein $W_E$ is the circumferential region width, and $W_M$ is the central region width.

3. The plasma display panel according to claim 2, wherein the upper dielectric layer and the lower dielectric layer are installed on the front substrate and the rear substrate, respectively, with a constant thickness.

4. The plasma display panel according to claim 2, wherein a passivation layer for protecting a surface is located on the upper dielectric layer.

5. The plasma display panel according to claim 2, wherein the discharge space of the barrier rib includes a phosphor layer which emits red, green, and blue light.

6. The plasma display panel according to claim 1, wherein the upper dielectric layer and the lower dielectric layer are installed on the front substrate and the rear substrate, respectively, with a constant thickness.

7. The plasma display panel according to claim 1, wherein the upper dielectric layer and the lower dielectric layer are installed on the front substrate and the rear substrate, respectively, with a constant thickness.

8. The plasma display panel according to claim 1, wherein when a thickness of the upper dielectric layer or the lower dielectric layer is changed, the circumferential region height satisfies the equation:

$$0.96H_M - XT_D < H_E < 0.98H_M - XT_D,$$

wherein, $XT_D$ is a total thickness of the upper dielectric layer and the lower dielectric layer of the barrier rib circumferential region minus a total thickness of the upper dielectric layer and the lower dielectric layer of the barrier rib central region.

9. The plasma display panel according to claim 1, wherein the barrier rib circumferential region is formed with step protrusions, the step protrusions of the barrier rib circumferential region having a lower height than a height of the barrier rib central region.

10. The plasma display panel according to claim 1, wherein the barrier rib circumferential region is formed with incline plane, the incline plane of the barrier rib circumferential region having a lower height than a height of the barrier rib central region.

11. The plasma display panel according to claim 1, wherein a passivation layer for protecting a surface is located on the upper dielectric layer.

12. The plasma display panel according to claim 1, wherein the discharge space of the barrier rib includes a phosphor layer which emits red, green, and blue light.

13. A plasma display panel comprising:

a front substrate having sustain discharge electrodes;

a rear substrate arranged parallel with the front substrate, the rear substrate having address electrodes crossing the sustain discharge electrodes;

an upper dielectric layer covering the sustain discharge electrodes;

a lower dielectric layer covering the address electrodes;

a barrier rib located between the front substrate and the rear substrate, the barrier rib forming discharge spaces between the front substrate and the rear substrate and having a barrier rib central region and a barrier rib circumferential region, the barrier rib central region having a central region height and the barrier rib circumferential region having a circumferential region height, the central region height being greater than the circumferential region height; and a frit spaced along a circumference of the barrier rib to attach the rear substrate to the front substrate, wherein when a thickness of the upper dielectric layer or the lower dielectric layer is changed, the circumferential region height satisfies the equation: $0.96H_M - XT_D < H_E < 0.98H_M - XT_D$, wherein $H_M$ is the central region height, $H_E$ is the circumferential region height, and $XT_D$ is a total thickness of the upper dielectric layer and the lower dielectric layer of the barrier rib circumferential region minus a total thickness of the upper dielectric layer and the lower dielectric layer of the barrier rib central region.

14. A plasma display panel comprising:

a front substrate having sustain discharge electrodes;

a rear substrate arranged parallel to the front substrate, the rear substrate having address electrodes crossing the sustain discharge electrodes; and a barrier rib located between the front substrate and the rear substrate, the barrier rib forming discharge spaces between the front substrate and the rear substrate and having a barrier rib central region and a barrier rib circumferential region, the barrier rib central region having a central region height, the barrier rib circumferential region having a circumferential region height, the central region height being greater than the circumferential region height, wherein a height of the barrier rib conforms to the equation $0.96H_M < H_E < 0.98H_M$, wherein $H_M$ is the central region height, and $H_E$ is the circumferential region height.

15. The plasma display panel as claimed in claim 14, wherein a circumferential region width of the barrier rib circumferential region and a central region width of the barrier rib central region conforms to the equation $W_E < 0.02\ W_M$, where $W_E$ is the circumferential region width and $W_M$ is the central region width.

16. The plasma display panel as claimed in claim 14, further comprising:

an upper dielectric layer formed on the front substrate, and a lower dielectric layer formed on the rear substrate, wherein when a thickness of the upper dielectric layer or the lower dielectric layer is changed, a height of the barrier rib conforms to the equation $0.96H_M - XT_D < H_E < 0.98H_M - XT_D$, where $XT_D$ is a total thickness of the upper dielectric layer and the lower dielectric layer of the barrier rib circumferential region minus a total thickness of the upper dielectric layer and the lower dielectric layer of the barrier rib central region.

17. A method of preventing substrate and barrier rib collisions in a plasma display panel, the plasma display panel having a front substrate, a rear substrate arranged parallel to the front substrate, and a barrier rib located between the front substrate and the rear substrate, the method comprising:

forming the barrier rib to have a barrier rib central region and a barrier rib circumferential region, the barrier rib central region having a central region height, the barrier rib circumferential region having a circumferential region height, the central region height being greater than the circumferential region height wherein a height of the barrier rib conforms to the equation $0.96H_M < H_E < 0.98H_M$, wherein $H_M$ is the central region height, and $H_E$ is the circumferential region height.

18. A barrier rib structure for a plasma display panel having a front substrate and a rear substrate arranged parallel to the front substrate, the barrier rib structure being located between the front substrate and the rear substrate, the barrier rib structure comprising:

a barrier rib central region and a barrier rib circumferential region, the barrier rib central region having a central region height, the barrier rib circumferential region having a circumferential region height, wherein the central region height is greater than the circumferential region height, wherein a height of the barrier rib conforms to the equation $0.96H_M < H_E < 0.98H_M$, wherein $H_M$ is the central region height, and $H_E$ is the circumferential region height.

* * * * *

UNITED STATES PATENT AND TRADEMARK OFFICE

CERTIFICATE OF CORRECTION

PATENT NO. : 7,656,091 B2
APPLICATION NO. : 11/838176
DATED : February 2, 2010
INVENTOR(S) : Dong Hyun Kim It is certified that error appears in the above-identified patent and that said Letters Patent is hereby corrected as shown below:

IN THE CLAIMS:

Column 7, lines 11-14, Claim 7 Delete Claim 7 in its entirety.

Signed and Sealed this
Twentieth Day of December, 2011

David J. Kappos

David J. Kappos
*Director of the United States Patent and Trademark Office*